United States Patent [19]

Johnston

[11] Patent Number: 4,575,254

[45] Date of Patent: Mar. 11, 1986

[54] TRANSIT MIXER SUPPORT PEDESTAL MOUNTING APPARATUS

[75] Inventor: James G. Johnston, Walnut, Calif.

[73] Assignee: Challenge-Cook Bros., Incorporated, Industry, Calif.

[21] Appl. No.: 596,630

[22] Filed: Apr. 4, 1984

[51] Int. Cl.[4] ..... B28C 5/18

[52] U.S. Cl. ..... 366/62; 248/582; 366/220; 366/232; 366/606

[58] Field of Search ..... 366/25, 53–61, 366/62, 63, 220, 225–229, 232, 233, 606; 248/569, 582, 598; 34/108, 135, 142; 432/118

[56] References Cited

U.S. PATENT DOCUMENTS

| | | | |
|---|---|---|---|
| 2,055,279 | 9/1936 | D'Aubarede | 248/582 |
| 3,216,666 | 11/1965 | Svensson et al. | 366/220 |
| 4,461,577 | 7/1984 | Mechem | 366/63 X |

*Primary Examiner*—Timothy F. Simone
*Attorney, Agent, or Firm*—Lyon & Lyon

[57] ABSTRACT

A mounting apparatus for a transit mixer support frame and pedestals including flexure joints and rotational joints. The flexure joints allow the front of the front pedestal and the back of the rear pedestal to move both vertically and laterally in response to conditional and dynamic loading of the transit mixer frame. The back of the front pedestal and the front of the rear pedestal are connected to the transit mixer frame through rotational joints. The rotational joints include support tubes extending transversely to the frame. Journal bearing portions are connected to the frame and fitted about the support tubes. The preferred embodiment of flexure joints utilize spring loaded bolts on the front of the front pedestal and the back of the rear pedestal. A second embodiment utilizes a transverse member with an oversized slot. A pin is connected to the pedestal and may move longitudinally and laterally within the slot. A third embodiment utilizes a transverse member and a single spring loaded bolt provides a simple three point mounting mechanism.

12 Claims, 16 Drawing Figures

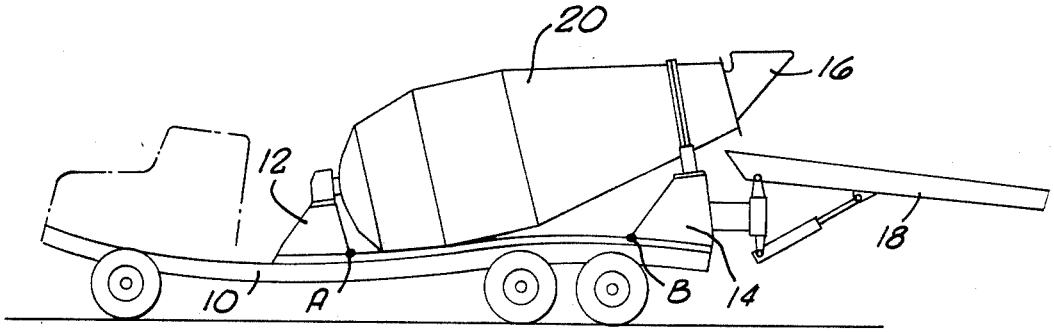
FIG. 2.
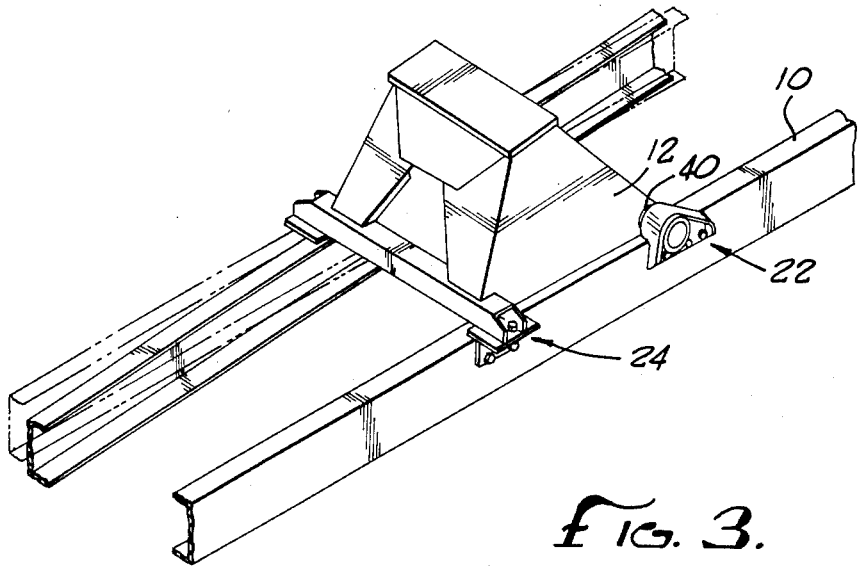
FIG. 3.
FIG. 4.
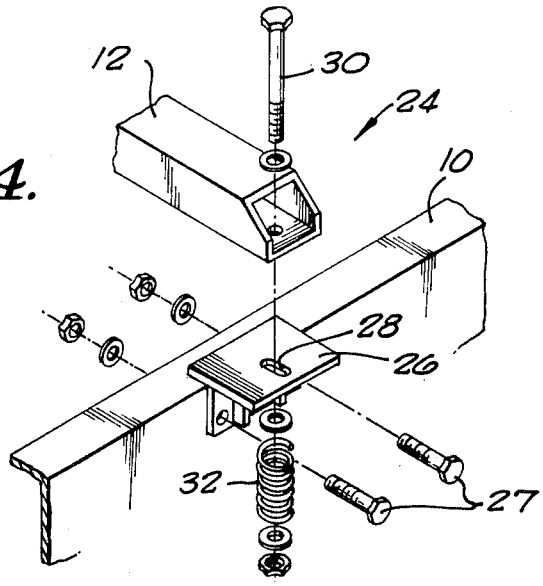
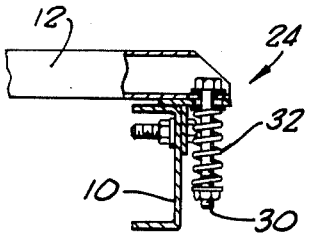
FIG. 5.

FIG. 6.
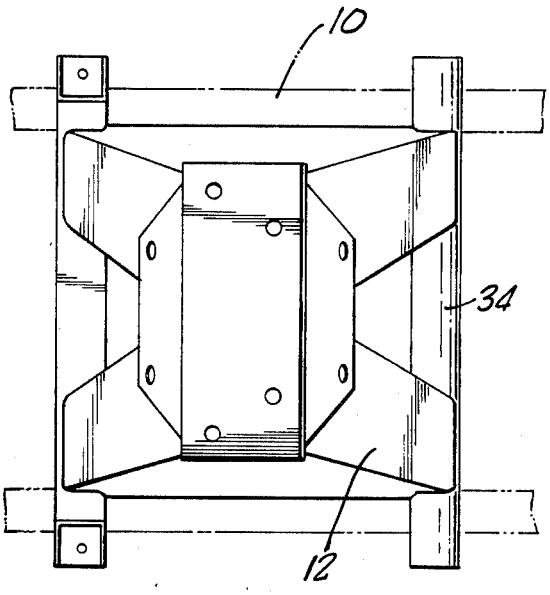
FIG. 8.
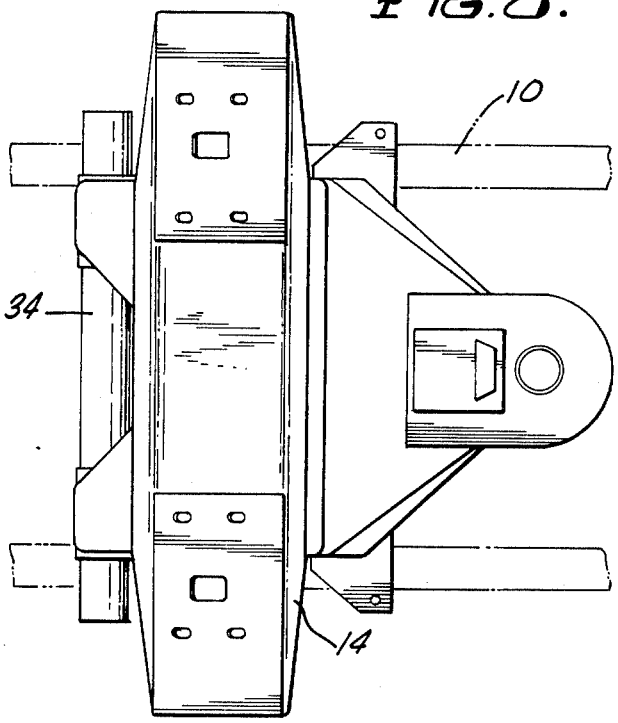
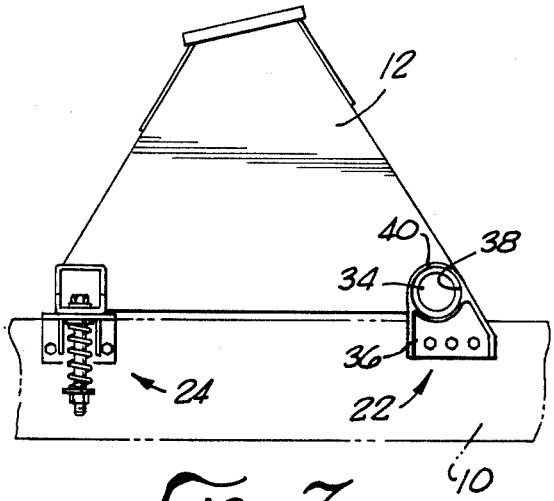
FIG. 7.
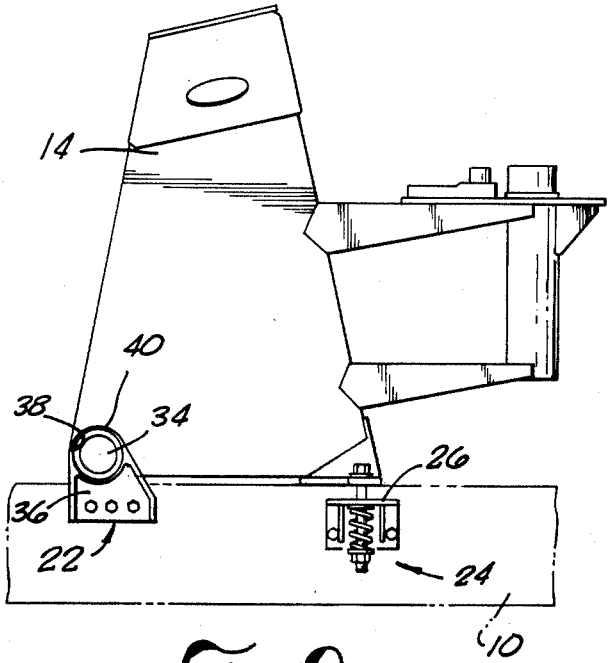
FIG. 9.

TRANSIT MIXER SUPPORT PEDESTAL MOUNTING APPARATUS

The field of the invention is transit mixer frames and more particularly mounting apparatus for transit mixer support frames and pedestals.

The function of a transit mixer frame and support pedestal is to provide a means of supporting the rotatable mixer drum, its driving means and the charging and discharging portions of the transit mixer. If the platform to which the mixer and its components is attached were stable, i.e. rigid and immobile, the design of the transit mixer frame and its attachment means would be simple and non-critical. Without exception, however, modern trucks and their frames are highly flexible in four general modes of flexure: vertical bending, resulting in vertical deflection; torsion, resulting in rotation of the frame or one members about its longitudinal center line; axial and lateral bending, resulting in parallelogramming and lateral deflection; and twist or local warping of individual members. See, for example, FIGS. 2 and 3.

A transit mixer frame will have two critical loading points, one located at each support pedestal. It is necessary to design a transit mixer support system to accommodate both the dynamic loads and deflections imposed due to the mobility and flexability of the vehicle and the conditional loads imposed by operation of the transit mixer.

Analysis of a rotating transit mixer drum frame is divided into two parts; a front support pedestal and rear support pedestal. The front support pedestal must support the front of the loaded mixer drum, resist the torque reaction of the drum drive, resist the longitudinal forces of the loaded mixer drum when the truck is decelerating from motion in its primary direction (forward) and its secondary direction (rearward). It must also resist lateral forces of the loaded mixer drum when the vehicle is cornering and be securely fastened to the flexible truck frame.

Typically, the gear reducer is supported by the front pedestal. As such, it is necessary to rigidly retain the gear reducer in a set position since flexure distortions of the gear reducer support platform will result in damage to the gear reducer. Attempts to flexibly mount gear reducers have been unsuccessful. Torque reactions from the loaded mixer drum plus the dynamic forces imposed on the flexible mounting apparatus have tended to overload flexible gear reducer mountings.

The second portion of the transit mixer support frame, the rear pedestal, must vertically support the rear of the loaded mixer drum through rollers; resist lateral forces such as those imposed by cornering; support the discharge end components, such as the discharge chute and the loading hopper; and still be securely fastened to the flexible truck frame. Due to the slippage between the rollers and the mixing drum track, little if any longitudinal loading such as that imposed by deceleration is imposed on the rear pedestal.

The prior art includes transit mixers wherein the support pedestals are attached directly to the truck frame as well as transit mixers having a sub-frame for supporting the mixer drum and the support pedestals. Conventional pedestal mounting, regardless of a whether a sub-frame is used, typically uses vertical bolts to connect to the pedestal mountings to the underlying support frame. Older designs used solid bolting on all four corners of the pedestals. Such a means for mounting the support pedestals was unsatisfactory due to the excessive loads put into the bolt due to frame deflections. More recently, manufacturers have been using spring-loaded bolting or no bolts at all on the front of the front pedestal and the rear of the rear pedestal. This was done in a generally unsuccessful attempt to relieve some of the loading and stresses created by truck frame deflections.

Frame deflection due to torsion is especially severe when the truck has tandem rear axles. In addition, the use of thinner material in an attempt to reduce weight of truck frames has made the problem of torsional bending more acute.

It is therefore an object of the present invention to provide a transit mixer frame mounting apparatus which will resist the loads and frame reactions due to the dynamic loads created by movement of the transit mixer, as well as accommodate the distortions of the flexible truck frame.

It is a further object of the invention to provide a transit mixer frame support mechanism which will accommodate the conditional loads, forces and flexures imposed by the mixer operation.

It is a further object of the invention to provide a mounting apparatus which may be used with a subframe or directly with the truck frame.

It is a further object of the invention to provide a mounting apparatus which will provide a flat and rigid platform for the mixer drum drive gear reducer by isolating the flexure of the truck frame from the platform. Other and more detailed objects of the invention will become apparent upon examination of the description and drawings contained herein, wherein:

FIG. 2 shows vertical deflection of a truck frame caused by a loaded mixer drum;

FIG. 3 shows torsional deflection of a frame member;

FIG. 4 shows an exploded view of a typical flexure joint;

FIG. 5 shows a cross-sectional view of the assembled flexure joint illustrated in FIG. 4;

FIGS. 6 and 7 show a top view and side view, respectively, of a front support pedestal attached to a frame using the preferred embodiment of the invention;

FIGS. 8 and 9 show a top view and side view, respectively, of a rear support pedestal attached to a frame using the preferred embodiment of the present invention;

Figure 1:
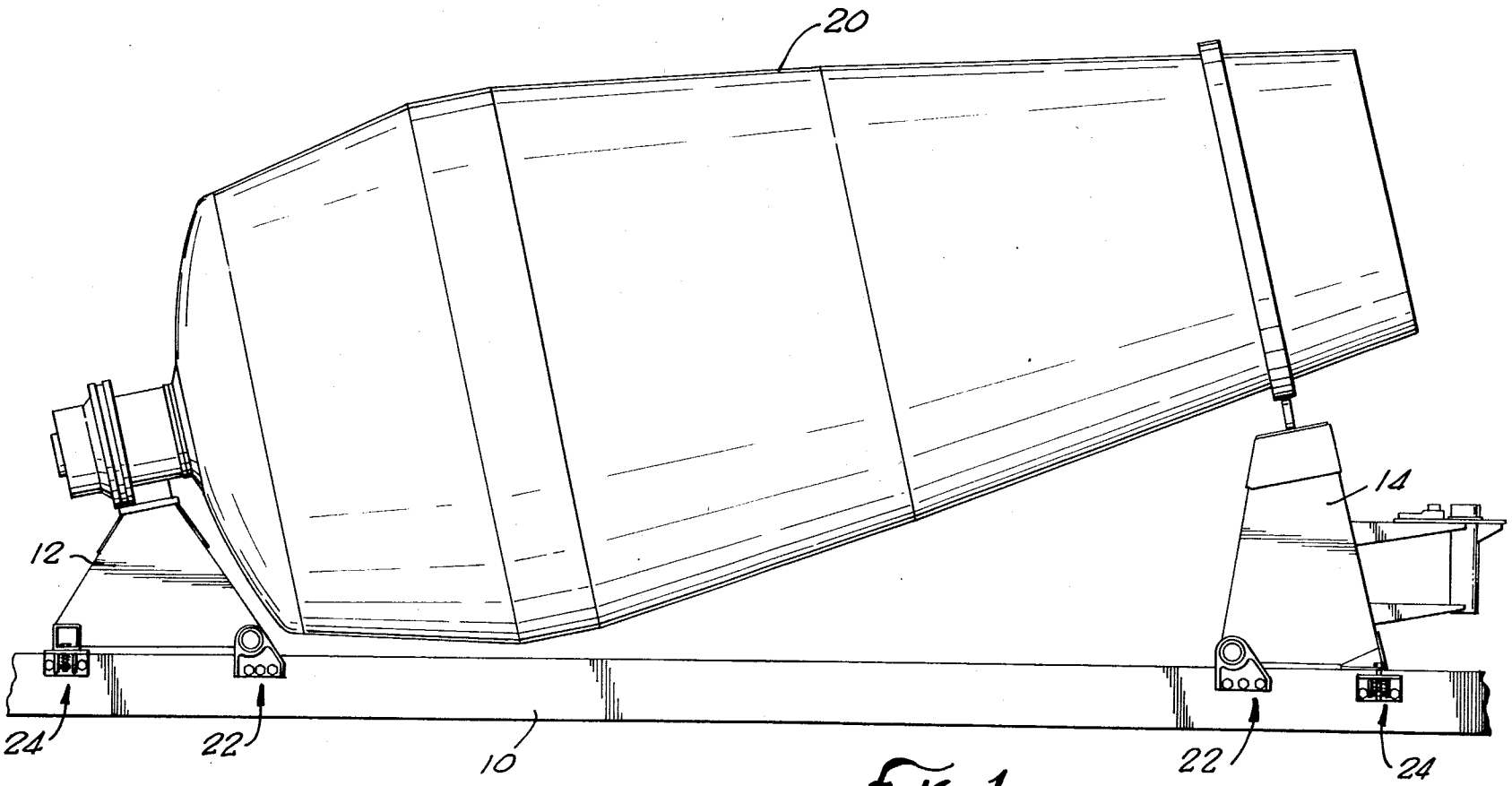
FIG. 1 is a side view of a transmit mixer drum and support pedestals attached to a frame using the present invention.
Figure 10:
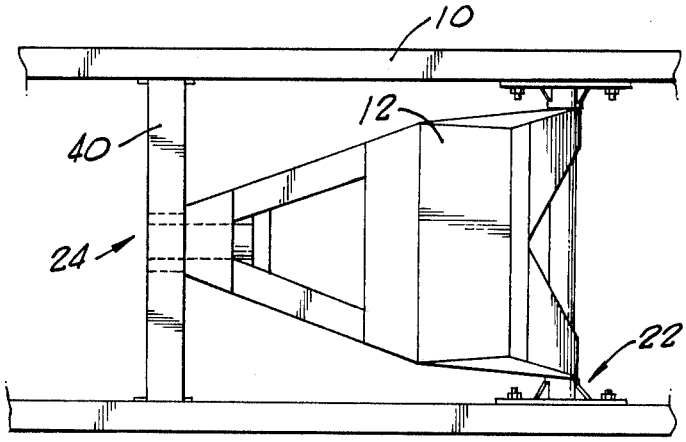
FIGS. 10 and 11 are top and side views, respectively, of a front pedestal using a second embodiment of the present invention.
Figure 11:
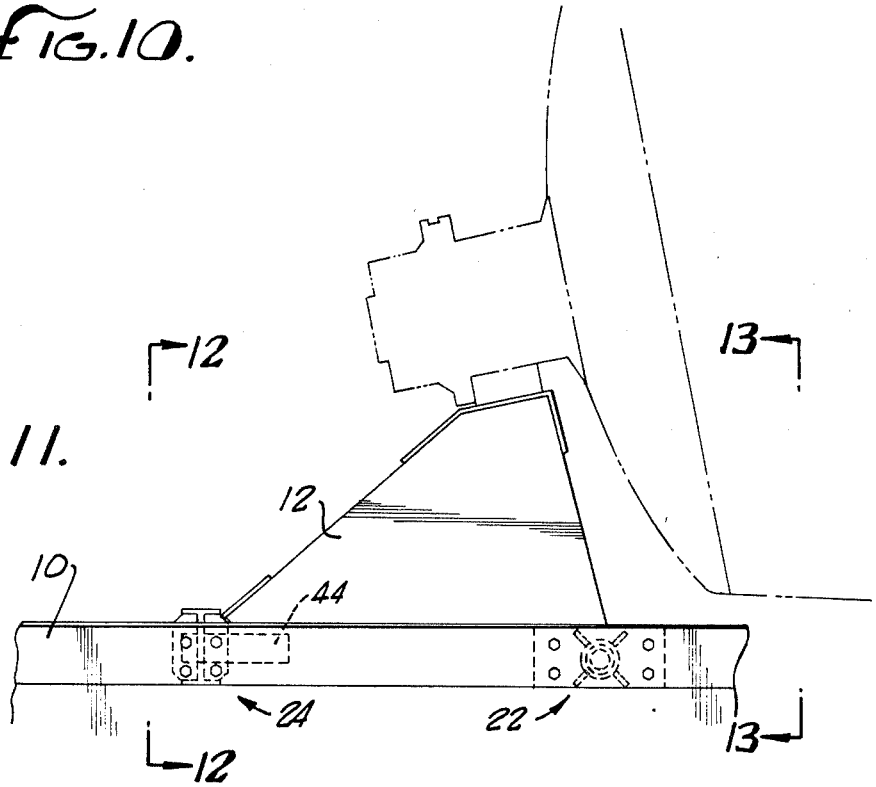
Figure 12:
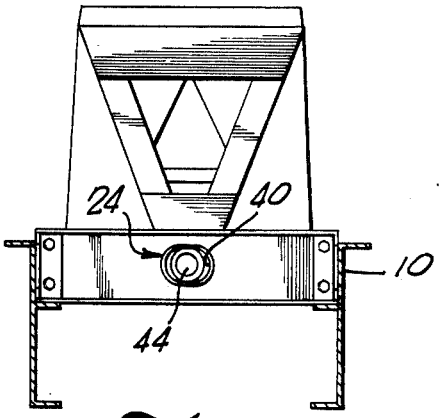
FIG. 12 is a front view of the second embodiment taken substantially along line 12—12 of FIG. 11.
Figure 13:
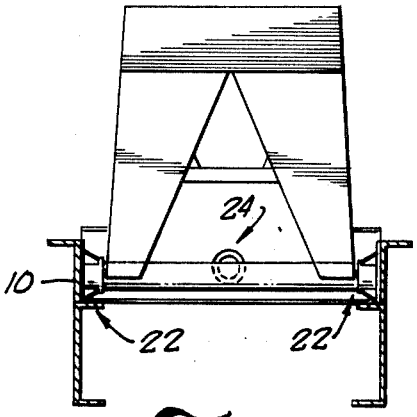
FIG. 13 is a rear view of the second embodiment of the present invention taken substantially along line 13—13 of FIG. 11.

As mentioned earlier, the vehicle frame in a transit mixer will have distortion due to conditional and dynamic forces in several directions. Since a truck sub-frame must be rigidly attached to the truck frame, the term "frame" used herein should be interpreted as applying to either a transit mixer truck frame or a separate sub-frame.

FIG. 2 shows an exaggerated amount of vertical deflection of a transit mixer 10. In order to securely retain the front support pedestal 12 and the rear support pedestal 14 to the frame 10 there are two critical points of attachment A and B.

The first critical point of attachment A is necessary to resist the forces of the mixer created by deceleration of the mixer from its direction of primary use, i.e., forward. These forward braking forces tend to move the front pedestal forward. Forward braking forces are more severe and of longer duration than braking forces from the secondary direction of use, i.e., reverse, since the vehicle speeds in the forward direction are greater compared to the vehicle speed in the reverse direction.

The second critical point of attachment B is necessary to retain the rear pedestal 14 in its position on the frame 10 due to the high loads imposed by loading of the transit mixer through the input hopper 16 and the forces created by a loaded discharge chute 18. The weight of the loaded mixer drum 20 tends to retain the front pedestal 12 and the rear pedestal 14 in contact with the mixer frame 10. As shown in FIG. 3, the support pedestals must also be able to accommodate lateral deflection of the frame 10 due to torsional loading.

In order to best accommodate these needs, the invention contemplates the use of two different types of joints on each pedestal, namely, rotational joints 22 and flexure joints 24. These joints are used to connect the front pedestal 12 and the rear pedestal 14 to the mixer frame 10.

As shown most clearly in FIG. 4, the flexure joint 24 has a mounting plate 26 attached to the frame 10 through bolt means 27. The mounting plate 26 has a tranverse slot 28 formed through its upper face to allow some lateral movement of the pedestal relative to the frame. Vertical connecting means 30, shown as a bolt in the figures, is used to connect the front of the front support pedestal 12 to the mounting plate 26. Flexible biasing means 32, shown in the figures as a spring, is placed between the lower face of the mounting plate and the end of the vertical connecting means 30. The flexible biasing means 32 are used to permit vertical movement of the front of the front pedestal 12 with respect to the mounting plate 26 without excessively loading the vertical connecting means 30. While the flexible biasing means 32 are shown in the figures as a spring, it is contemplated that other flexible biasing means such as a rubber donut or the like may be used in its place.

Flexure joints 24 as described above are used to connect the front of both sides of the front pedestal 12 to corresponding mounting plates 26 affixed to the frame 10. Similarly, flexure joints 24 as set forth above are used to connect both sides of the back of the rear support pedestal 14 to corresponding mounting plates 26 attached to the frame 10 as shown in FIG. 9.

The rotational joints 22, as shown in FIGS. 6–9, include a support tube 34 extending transversely to the frame members 10. Mounting plates 36 having a journal bearing 38 formed transversely therethrough are fitted about the support tube 34 and connected to the frame 10. A pair of rotational joints 22 are used to mount the back of the front support pedestal 12 to the frame 10. Similarly, another pair of rotational joints 22 are used to mount the front of the rear support pedestal 14 to the frame 10. In both cases, the appropriate legs of the front and rear support pedestals 12 and 14, respectively, are attached to the support tube 34 which is rotatable within the journal bearings 38 of the mounting plates 36.

In the aforedescribed embodiment of the invention, as well as the embodiments to be described, each pedestal has one end mounted to pivot about a lateral axis by the joints 22 and the amount of pivoting can differ from one side to the other, all without imposing any significant bending or twisting forces on the pedestal. The front pedestal joint 22 is at its rear to advantageously resist the high forwardly directed forces imposed by the mixer drum, such as upon braking from high speed, although it allows pivoting (limited by flexure joints 24) in response to rearwardly directed forces from the drum. Conversely, the rear pedestal joint 22 is at its front to advantageously resist the rearwardly directed forces from the drum through the track support, which forces are normally substantially less. The flexure joints 24 on both pedestals allow movement of the pedestals in the various directions caused by the bending, twisting, flexing, laddering, etc. of the frame.

A second embodiment of the present invention is shown in FIGS. 10–13 and has a three-point mounting support rather than the aforedescribed four-point mounting. In the second embodiment, the flexure joint 24 connecting the front of the front pedestal 12 includes a transverse support member 40 having an oversized slot 42 formed along its longitudinal axis. A pin 44 protrudes from the front of the front pedestal support 12 and is fitted within the slot 42 so as to be able to move both laterally and longitudinally in the slot with some limited vertical movement. A pair of rotational joints 22 similar to those described above are used to connect the back of the front support pedestal 12 to the frame 10.

Figure 14:
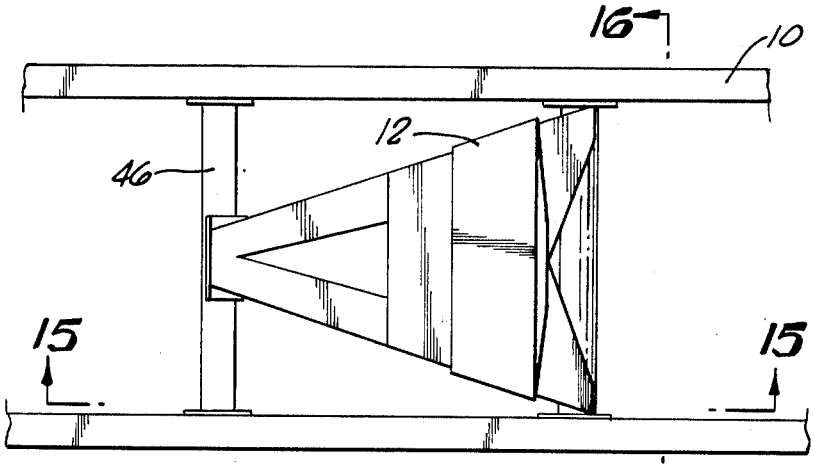
FIG. 14 is top view of a front pedestal using a third embodiment of the present invention.
Figure 15:
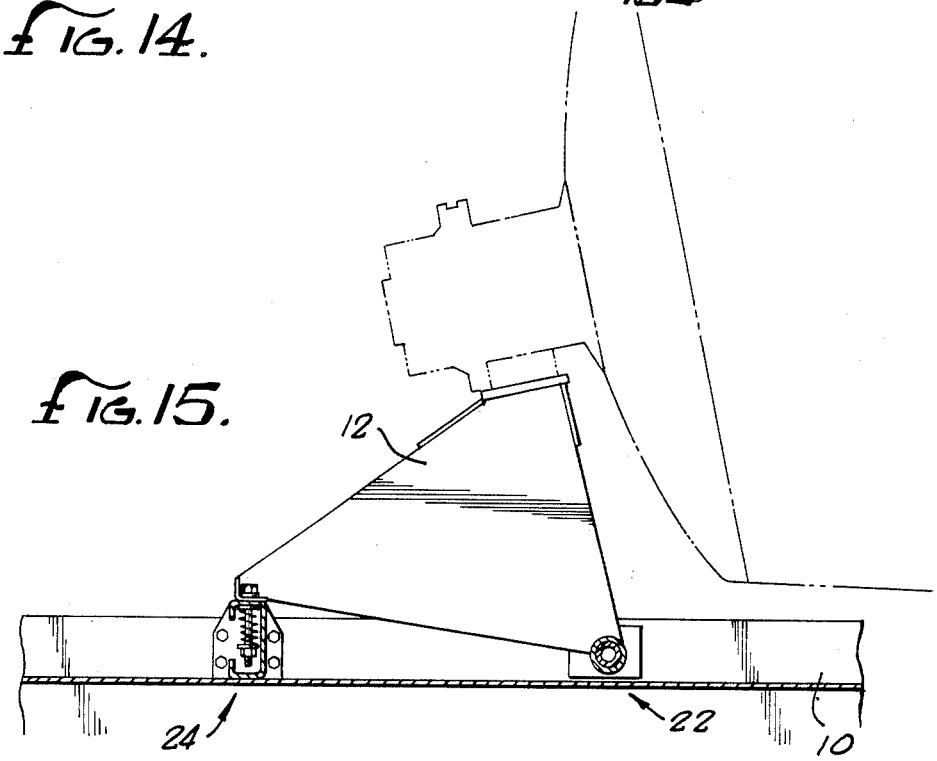
FIG. 15 is sectional view of a front pedestal using the third embodiment of the present invention taken substantially along line 15—15 of FIG. 14.
Figure 16:
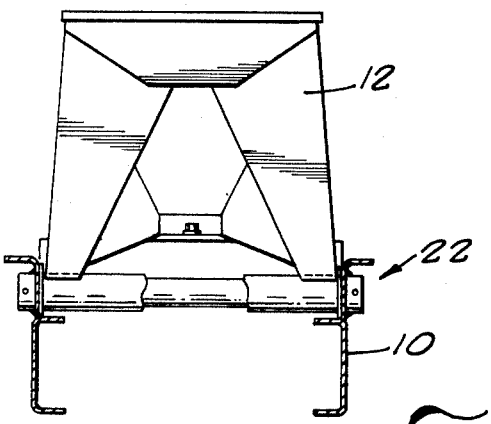
FIG. 16 is a rear view of a front support pedestal using the third embodiment of the present invention taken substantially along line 16—16 of FIG. 14.

A third embodiment of the invention shown in FIGS. 14–16 is also a three-point mounting arrangement. In the third embodiment a transverse support member 46 extends between the longitudinal members of the frame 10. A single flexure joint 24 such as that described in the first embodiment is mounted on the transverse member. Rotational joints 22 such as those described hereinabove are used to connect the rear of the front support pedestal 12 to the members of the frame 10. The use of a transverse member 46 with the flexure joints 24 of the first embodiment provides a simple three-point mounting apparatus for the front support pedestal 12.

While the second and third embodiments are illustrated in the form of front pedestals, it is to be understood that either can also be used as rear pedestals. Moreover, the pedestals of the three embodiments may be used in any combination for either the front or rear.

The details of the above specification are used for purposes of example only and should not be construed to limit the scope of the appended claims. In addition, it is anticipated that the position of the flexure joints 24 and the rotational joints 22 may be interchanged if the primary direction of operation is reverse rather than forward or other considerations so dictate.

We claim:

1. A mounting apparatus for a transit mixer having a frame, a front support pedestal and a rear support pedestal, both pedestals having a front and a back, comprising, a first rotational joint means pivotally connecting the back of the front pedestal to the frame, a second rotational joint means pivotally connecting the front of the rear pedestal to the frame, a first flexure joint means connecting the front of the front pedestal to the frame, a second flexure joint means connecting the back of the rear pedestal to the frame, said flexure joint means being arranged so as to allow relative movement between the pedestal and the frame.

2. A mounting apparatus as set forth in claim 1 wherein one of said flexure joint means includes a pair of mounting plates fixedly connected to the frame, each said mounting plate having a tranverse slot formed therethrough and spring-loaded connection means connecting said mounting plates to the front of the front pedestal.

3. A mounting apparatus as set forth in claim 2 wherein the other of said flexure joint means includes a pair of mounting plates fixedly connected to the frame, each said mounting plate having a transverse slot formed therethrough and spring-loaded connection means connecting said mounting plates to the back of the rear pedestal.

4. A mounting apparatus as set forth in claim 1 wherein one of said flexure joint means includes a transverse frame member, said member having an oversized slot formed along its longitudinal axis and a pin protruding from the front of the front pedestal, said pin being connected to said transverse member and slidable within said slot.

5. A mounting apparatus as set forth in claim 4 wherein the other of said flexure joint means is the second flexure joint means and includes a pair of mounting plates fixedly connected to the frame, each said mounting plate having a transverse slot formed therethrough and spring-loaded connection means connecting said mounting plates to the back of the rear pedestal.

6. A mounting apparatus as set forth in claim 1 wherein one of said flexure joint means includes a transverse frame member, a mounting plate fixedly connected to said transverse member, said mounting plate having a slot formed therethrough in the longitudinal direction of said transverse member and spring-loaded connection means connecting said mounting plate and that pedestal and being slidable in said slot.

7. A mounting apparatus as set forth in claim 6 wherein the other of said flexure joint means includes a pair of mounting plates fixedly connected to the frame, each said mounting plate having a transverse slot formed therethrough and spring-loaded connection means connecting said mounting plates to that pedestal.

8. In a mounting apparatus for a transit mixer vehicle having a mixer drum, a frame and front and rear pedestals for supporting the mixer drum on the frame, the improvement comprising, at least one of the pedestals having one longitudinal end pivotally connected to the frame by a rotational joint means and the other longitudinal end connected to the frame by a flexure joint means having means for allowing limited relative movement between the pedestal and the frame, the rotational joint means and flexure joint means serving to accommodate both the dynamic loads and deflections imposed due to the mobility and flexibility of the vehicle and the conditional loads imposed by operation of the transit mixer.

9. The mounting apparatus of claim 8 wherein each of the pedestals is provided with at least one said rotational joint means and at least one said flexure joint means.

10. The mounting apparatus of claim 9 wherein said rotational joint means on each of the pedestals are on the longitudinal end closer to the other pedestal.

11. The mounting apparatus of claim 8 wherein said rotational joint means includes a transverse member having separate pivotal connections to two laterally spaced locations on the frame.

12. The mounting apparatus of claim 8 wherein the said flexure joint means is comprised of a single point mounting means.

* * * * *